United States Patent [19]

Cohen

[11] Patent Number: 4,536,974

[45] Date of Patent: Aug. 27, 1985

[54] SHOE WITH DEFLECTIVE AND COMPRESSIONABLE MID-SOLE

[76] Inventor: Eli Cohen, 350 Continental Ave., Paramus, N.J. 07652

[21] Appl. No.: 548,614

[22] Filed: Nov. 4, 1983

[51] Int. Cl.[3] ..... A43B 13/18; A43B 7/08

[52] U.S. Cl. ..... 36/28; 36/25 R; 36/3 B

[58] Field of Search ..... 36/28, 29, 35 R, 25 R, 36/31, 3 R, 3 B

[56] References Cited

U.S. PATENT DOCUMENTS

| | | | |
|---|---|---|---|
| 625,393 | 5/1899 | Hafertepen | 36/3 R |
| 1,304,915 | 5/1919 | Spinney | 36/29 |
| 1,869,257 | 7/1932 | Hitzler | 36/29 |
| 2,698,105 | 3/1959 | Rizzo | 36/2.5 |
| 3,079,707 | 12/1959 | Hack et al. | 36/28 |
| 3,087,262 | 4/1961 | Russell | 36/28 |
| 3,172,217 | 2/1963 | Colman | 36/28 |
| 4,129,951 | 12/1978 | Petrosky | 36/29 |
| 4,309,832 | 1/1982 | Hart | 36/31 |
| 4,451,994 | 6/1984 | Fowler | 36/28 |

FOREIGN PATENT DOCUMENTS

| | | | |
|---|---|---|---|
| 2809011 | 8/1979 | Fed. Rep. of Germany | 36/3 B |
| 958766 | 9/1949 | France | 36/28 |
| WO81/01234 | 5/1981 | PCT Int'l Appl. . | |
| 1603646 | 11/1981 | United Kingdom | 36/29 |

*Primary Examiner*—Werner H. Schroeder
*Assistant Examiner*—Steven N. Meyers
*Attorney, Agent, or Firm*—Mitchell B. Wasson; Martin P. Hoffman

[57] ABSTRACT

A shoe containing a plurality of pairs of transverse ribs provided between the mid-sole and the outer sole. All of the ribs are provided with at least one bowed or convex surface running the length of the rib. When weight is placed upon the sole, each of the ribs initially begins to deflect and then the ribs are compressed. The ribs begin to become compressed when one of each pair of the ribs would intrude upon an adjacent rib of a second pair of ribs.

9 Claims, 7 Drawing Figures

(RELAXED STATE)

(COMPRESSED STATE)

(RELAXED STATE)

(COMPRESSED STATE)

(RELAXED STATE)

(COMPRESSED STATE)

SHOE WITH DEFLECTIVE AND COMPRESSIONABLE MID-SOLE

BACKGROUND OF THE INVENTION

For the last several years, we have witnessed a great increase in the amount of people who either run or jog as a recreational sport. However, concommitant with this increase, is a large number of injuries or conditions which are produced from utilizing athletic shoes which do not properly cushion the user's feet.

As is recognized by those skilled in the art, as well as those millions of recreational runners, good impact absorption and flexibility are two extremely important characteristics desired in athletic shoes. The athletic shoe sole should permit a great deal of flexibility at the point where the foot naturally flexes, while being sufficiently tough to withstand shock, yet soft enough to provide adequate cushioning and comfort. This flexible, yet strong feature is very useful in non-athletic, as well as athletic shoes.

The sole structure of most commercially available today is a tripartite construction including an outer sole, a mid-sole and an inner sole. The outer sole is normally formed of a tough, abrasion-resistant material, since it is the portion of the sole which contacts the ground. The mid-sole is the portion of the shoe between the outer sole and the inner sole and its function is to provide lift for the heel and cushioning for the entire shoe. The inner sole is normally used to join the mid-sole to the shoe structure itself.

Most mid-soles commercially available at the present time utilize a single layer of compressionable rubber-like or similar material. The force needed to initially compress this material is minimal, but as additional force is placed upon the material, a greater amount of force is needed to further compress the material.

U.S. Pat. Nos. 2,968,105 issued to Rizzo; 3,079,707 issued to Hack et al; 3,087,262 issued to Russell; 3,172,217 issued to Colman and PCT Application WO No. 81/01234 show the use of either mid-soles or outer soles which are provided with ribs or ridges which contain at least one portion which is slanted with respect to the normal plane of the shoe. These particular shoe sole designs initially deflect when a force is applied to the sole. Contrary to the compressive force, the force initially used to cause a deflection of the ribs or ridges is rather large, but as additional force is applied, the average amount of force needed to produce additional deflection lessens.

While it has been determined that the use of a material able to deflect when force is applied thereto provides a better cushioning surface than utilizing a single sheet of material for the mid-sole, it has also been determined that a shoe which provides even more cushioning must be developed.

SUMMARY OF THE INVENTION

Broadly, the present invention combines the teaching of the prior art single sheet mid-sole with that of the prior art mid-sole containing a plurality of ribs capable of being deflected.

The present invention accomplishes this end by providing a mid-sole containing a plurality of pairs of transverse ribs, each pair of ribs containing oppositely bowed, arcuate or convex-shaped material. These pairs of ribs are spaced from adjacent pairs of ribs such that after each rib has been deflected, it intrudes upon a rib of an adjacent pair. In this manner, each rib of the mid-sole would initially be deflected and then when it abuts an adjacent rib, compression of these ribs would take place.

Other objects and many of the attendant advantages of the instant invention will be readily appreciated as it becomes better understood by reference to the following detailed description when considered in connection with the accompanying drawings.

DETAILED DESCRIPTION OF THE INVENTION

Figure 1:
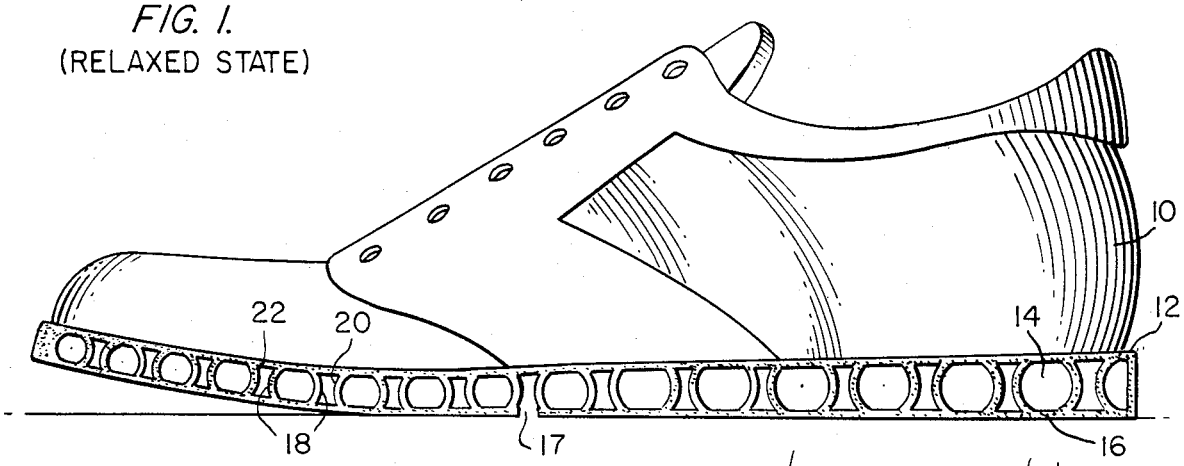
FIGS. 1, 3 and 5 show various embodiments of the present invention in the undeflected and uncompressed state.

As shown in FIG. 1, a shoe 10 is provided with an inner sole 12, a mid-sole 14 and an outer sole 16. The inner sole 12 consists of a sheet of rubber or leather material. The mid-sole 14 contains a plurality of pairs of ribs 18. These ribs are transverse to the longitudinal axis of the shoe and are applied over virtually the entire length of the shoe. Additionally, in one embodiment each pair of ribs run for substantially the entire width of the shoe, or in a second embodiment explained heretofore, the ribs do not run the entire width of the shoe. Although it is not crucial for the invention, each pair of ribs is constructed from a rubber-like or similar material. As shown in FIG. 1, each of the ribs of the pair of ribs 18 is bowed oppositely with respect to one another. The outer sole 16 is also constructed from a variety of materials commonly utilized by athletic as well as non-athletic shoes. Alternatively, the inner sole 12, the mid-sole 14 and the outer-sole 16 can be extruded as an entire unit.

Figure 2:
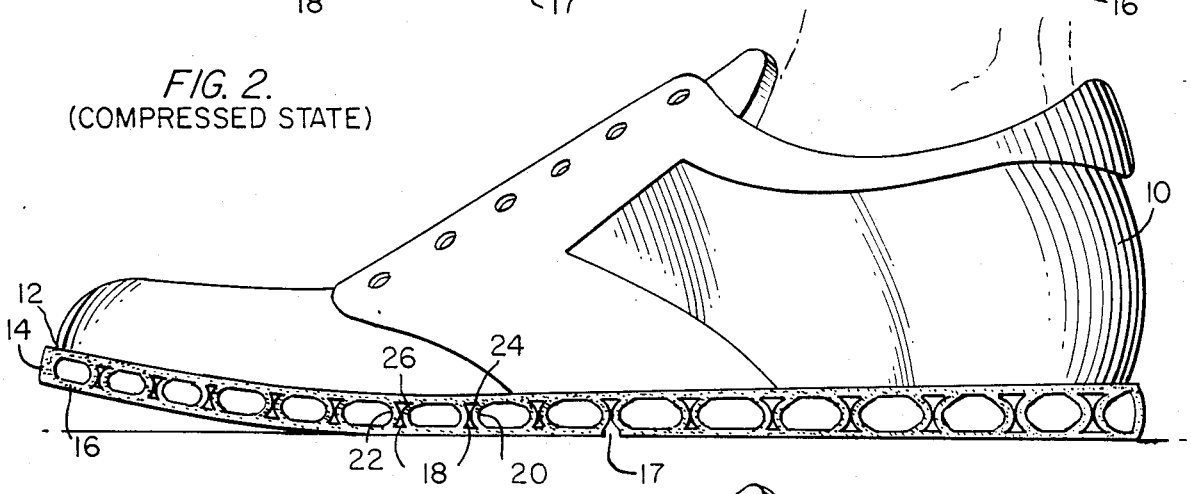
FIGS. 2, 4 and 6 show various embodiments of the present invention in the deflected and compressed state.

When an individual walker, runner or jogger applies force normal to the soles, as is shown in FIG. 2, each of the ribs initially deflects. As indicated hereinabove, a relatively large force is needed to initially deflect the ribs, but as the ribs are deflected to a greater extend, relatively less force is needed to deflect the ribs further. Each pair of ribs is separated from adjacent pairs of ribs such that after a predetermined force has been applied, one of the pairs of ribs 18 intrudes upon an adjacent rib 20 of a second pair of ribs at 24, while the second rib of the pair 18 intrudes upon its adjacent rib 22 of a third pair of ribs at 26. From this point on, as additional force is applied normal to the sole, the ribs will be compressed. Since a minimal amount of force is needed for the ribs to initially be compressed and a continually greater amount of force is needed to further compress the ribs, the particular configuration of the mid-sole of the present invention provides a sole in which a relatively constant amount of force is needed to both deflect and compress the sole as force is applied to the sole while the individual is running, walking or jogging.

The ultimate result of this sole which requires a relatively great amount of pressure followed directly by a relatively light amount of pressure needed to deflect the ribs coupled with the relatively small amount of pressure followed by a relatively large amount of pressure necessary to compress the ribs produces a sole which is light, inexpensive and is capable of achieving an extremely soft and even step.

Figure 3:
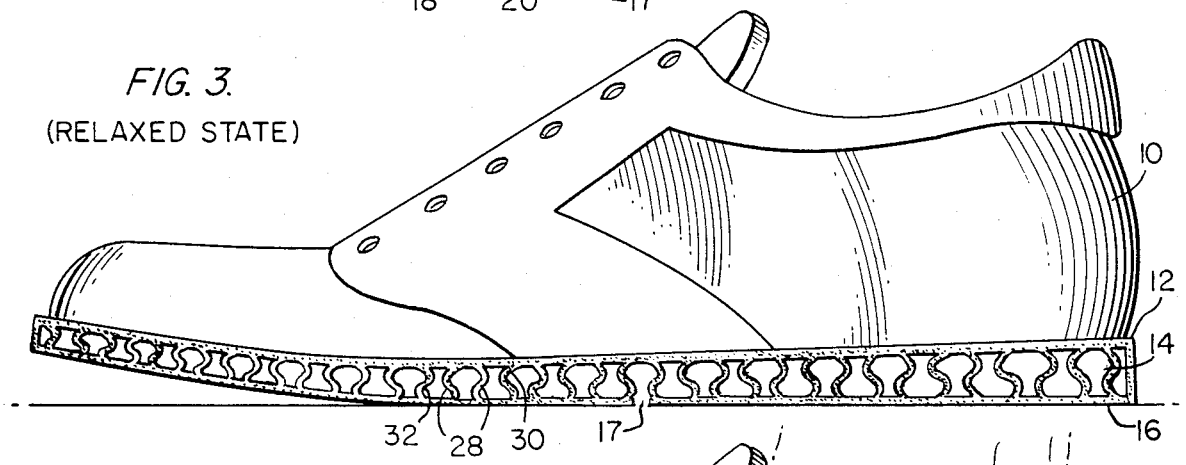
Figure 4:
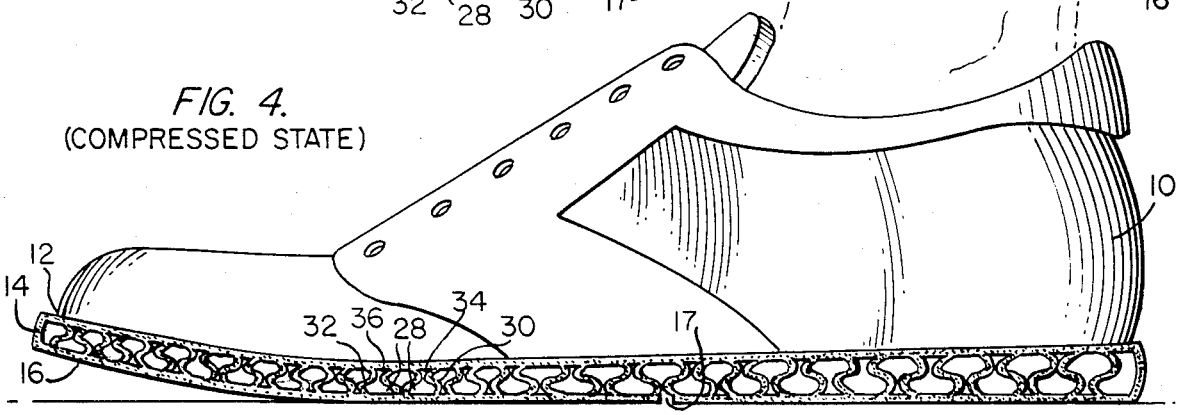
Figure 5:
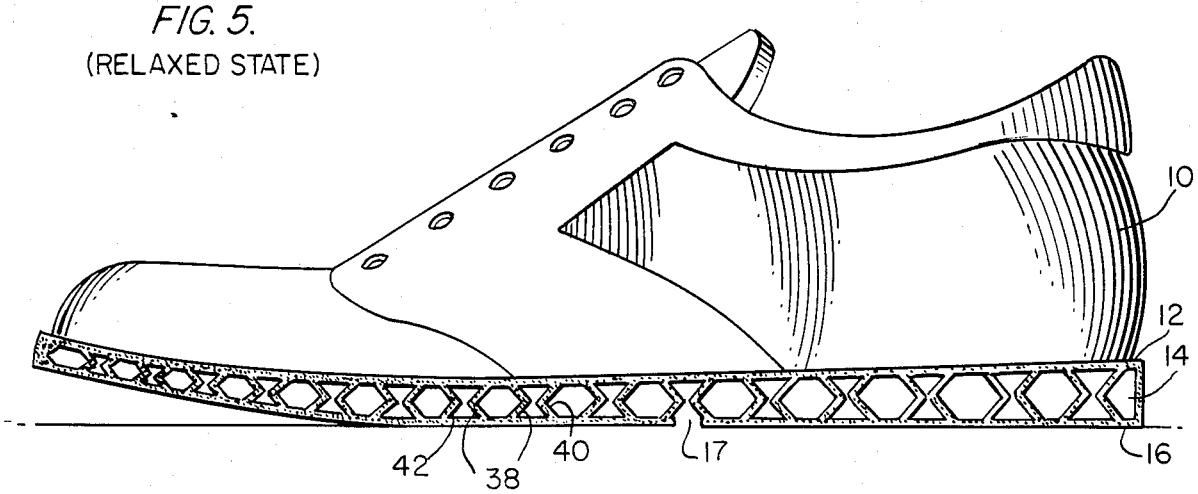

FIGS. 3 and 5 show different embodiments of the present invention. FIG. 3 shows a shoe in which each of a pair of ribs 28 contains one forwardly facing contoured "S"-shaped rib and an oppositely facing contoured "S"-shaped rib. As was true with respect to the shoe described in FIGS. 1 and 2, each of the ribs is initially deflected until adjacent ribs 30 and 32 abut at 24 and 26, at which point any additional force applied to the sole would act as a force to compress the ribs 28 of the mid-sole 14, as is shown in FIG. 4.

Figure 6:
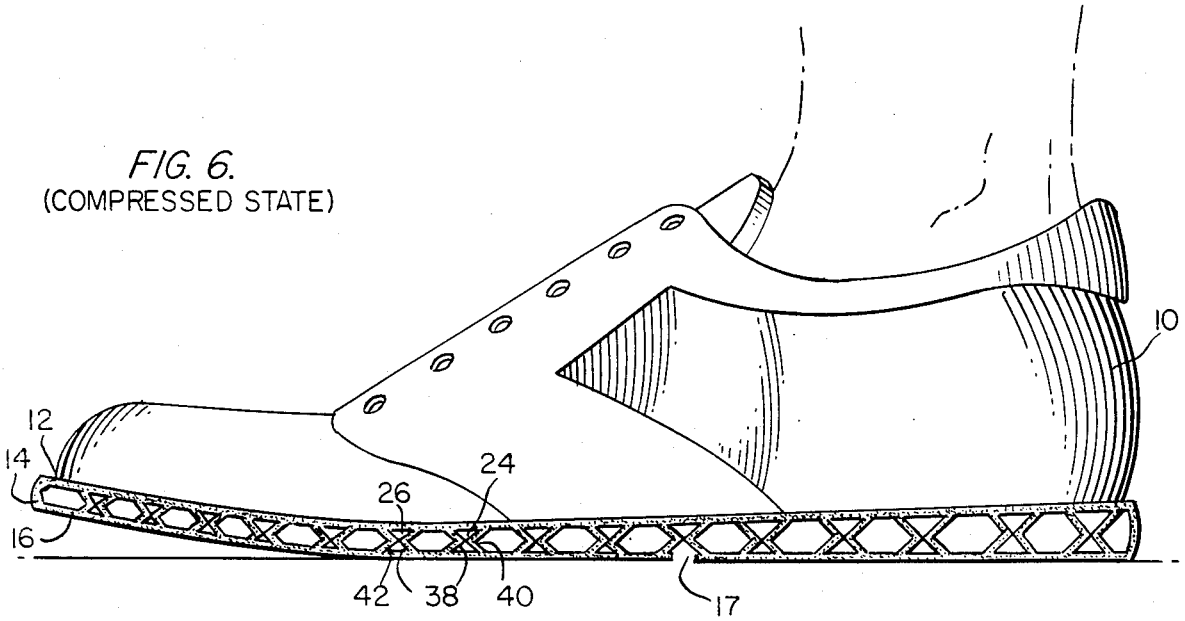

Similarly, FIG. 5 shows a shoe 10 provided with a plurality of pairs of ribs 38, each pair of ribs forming a "diamond" design. Furthermore, as was true with respect to the shoes shown in FIGS. 1–4, this "diamond" design would initially deflect when force is provided normal to the sole until adjacent ribs 40 and 42 intrude upon the ribs 38 at 24 and 26, respectively, at which time the ribs 38 of the mid-sole 14 would compress, as is shown in FIG. 6.

Each of the outer soles 16 can be provided with one or more transverse slits 17, to reduce the effort required to flex the shoe during the normal heel-raising mode used in running or walking.

Shoes constructed according to the present invention could provide a varying degree of cushioning needed to compensate for different shock loads produced as different portions of the shoe contact the ground during athletic or other endeavors. Additionally, the spacing between each pair of the ribs as well as the thickness of the ribs and the length of the ribs can be increased or decreased depending upon the weight of the individual, or the particular activity for which the shoe is designed.

While this invention has been described with particular reference to the construction shown in the drawings, it is to be understood that such is not to be construed as imparting limitations upon the invention.

Figure 7:
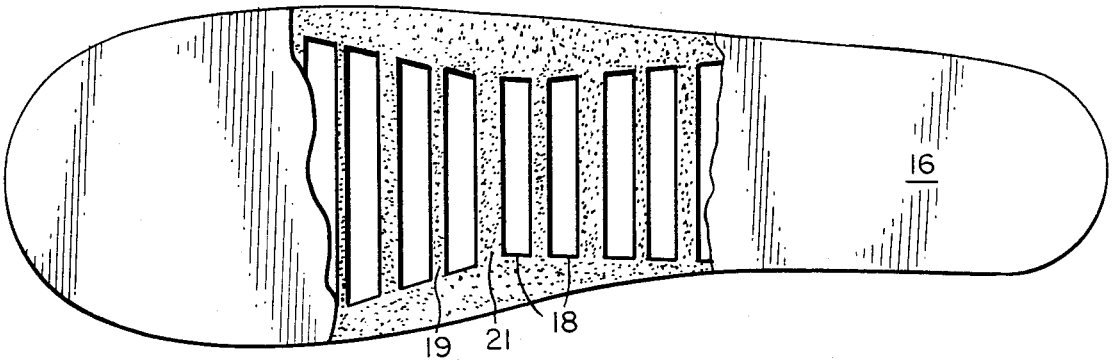
FIG. 7 is a cut away view showing the ribs of the shoe.

Furthermore, it should be noted that various other configurations of the mid-sole can be utilized as long as the mid-sole is initially deflected until each rib intrudes upon an adjacent rib, at which time the ribs of the mid-sole will begin to be compressed if further force is applied thereto. For example, the ribs 18 can be variably spaced from one-another or be of varying length for maximum cushioning effect, or they can be of varying thickness for specific weight loads. Additionally, the spacing and length of the ribs can be altered depending upon the particular nature of the sport or activity to which the shoe will be put to use. As shown in FIG. 7, the spacing 19 between the two ribs is less than the spacing 21 between two additional ribs. Furthermore, the length of each of the ribs can vary with respect to one another.

What is claimed is:

1. A sole component for a shoe comprising:

an inner sole provided directly underneath the shoe;

a mid-sole provided directly underneath said inner sole, said mid-sole provided with a plurality of pairs of ribs transverse to the longitudinal axis of said shoe, each of said pairs of ribs provided with first and second ribs, said first rib of one of said pairs of ribs provided with at least one portion angled with respect to said inner sole, and said second rib of said one of said pairs of ribs provided with at least one portion angled with respect to said inner sole and angled oppositely from said angled portion of said first rib, each of said pairs of ribs initially spaced from adjacent pairs of ribs such that when a force is applied normal to said shoe, each of said ribs freely deflects until each of said first ribs of said pairs of ribs intrudes upon a second rib of an adjacent pair of said ribs, at which point said ribs begin to compress; and an outer sole provided directly underneath said mid-sole.

2. The sole in accordance with claim 1, wherein each of said pairs of ribs contains a first bowed rib and a second rib bowed oppositely with respect to said first rib.

3. The sole in accordance with claim 1, wherein each of said pairs of ribs contains a first "S"-shaped rib and a second "S"-shaped rib facing said first "S"-shaped rib.

4. The sole in accordance with claim 1, wherein each of said pairs of ribs forms a "diamond" shape.

5. A sole component for a shoe in accordance with claim 1, wherein the spacing between said ribs is varied.

6. A sole component for a shoe in accordance with claim 1, wherein the thickness of said ribs is varied.

7. A sole component for a shoe in accordance with claim 1, wherein the width of each of said ribs is varied.

8. A sole component for a shoe in accordance with claim 1, wherein a transverse slit is provided in said outer sole.

9. A sole component for a shoe in accordance with claim 1, wherein each of said pairs of ribs substantially defines an open-ended cylinder.

* * * * *